United States Patent [19]

Küpper

[11] Patent Number: 4,724,666

[45] Date of Patent: Feb. 16, 1988

[54] DEVICE FOR KEEPING A CONSTANT NUMBER OF BOBBIN TUBES IN CIRCULATION BETWEEN A SPINNING MACHINE AND A WINDING MACHINE

[75] Inventor: Wilhelm Küpper, Wegberg, Fed. Rep. of Germany

[73] Assignee: W. Schlafhorst & Co., Monchen-Gladbach, Fed. Rep. of Germany

[21] Appl. No.: 805,339

[22] Filed: Dec. 4, 1985

[30] Foreign Application Priority Data

Dec. 14, 1984 [DE] Fed. Rep. of Germany ..... 3445678

[51] Int. Cl.[4] ..... D01H 9/00; D01H 9/18; B65H 54/22; B65H 73/00

[52] U.S. Cl. ..... 57/276; 28/292; 28/293; 57/281; 209/927; 242/35.5 A

[58] Field of Search ..... 28/292, 293; 242/35.5 A; 209/927; 57/276, 281

[56] References Cited

U.S. PATENT DOCUMENTS

| | | | |
|---|---|---|---|
| 2,886,940 | 5/1959 | Urano et al. | 242/35.5 A X |
| 3,195,298 | 7/1965 | Furst | 28/293 X |
| 3,224,694 | 12/1965 | Oishi | 242/35.5 A X |
| 4,063,635 | 12/1977 | Heckel | 242/35.5 A X |
| 4,518,136 | 5/1985 | Rohner | 242/35.5 A |
| 4,544,107 | 10/1985 | Matsui et al. | 242/35.5 A |
| 4,545,551 | 10/1985 | Uchida et al. | 242/35.5 A |
| 4,571,931 | 2/1986 | Kupper | 57/281 |
| 4,586,668 | 5/1986 | Mori | 28/292 X |

FOREIGN PATENT DOCUMENTS

| | | | |
|---|---|---|---|
| 3337348 | 4/1984 | Fed. Rep. of Germany | 242/35.5 A |
| 47-5221 | 2/1972 | Japan | 242/35.5 A |
| 48-4229 | 2/1973 | Japan | 28/293 |
| 233826 | 11/1944 | Switzerland | 28/293 |
| 210760 | 3/1969 | U.S.S.R. | 28/293 |

*Primary Examiner*—Robert R. Mackey

*Attorney, Agent, or Firm*—Herbert L. Lerner; Laurence A. Greenberg

[57] ABSTRACT

A device for keeping a constant number of bobbin tubes in circulation between at least one spinning machine and at least one winding machine includes a device for circulating bobbin tubes between at least one spinning machine and at least one winding machine, a sorting device for sorting out partially wound bobbin tubes from the circulating device, and a tube input apparatus operatively connected to the sorting device including a tube magazine for introducing empty bobbin tubes into the circulating device in proportion to the number of partially wound bobbin tubes sorted out.

3 Claims, 2 Drawing Figures

DEVICE FOR KEEPING A CONSTANT NUMBER OF BOBBIN TUBES IN CIRCULATION BETWEEN A SPINNING MACHINE AND A WINDING MACHINE

BACKGROUND OF THE INVENTION

1. Field of the Invention:

The invention relates to a device for keeping a constant number of bobbin tubes in circulation between at least one spinning machine and at least one winding machine through the use of a sorting device for partially wound bobbin tubes.

Bobbin tubes are taken out of circulation at varied speeds by the sorting device so that from time to time a certain quantity of bobbin tubes must somehow be brought into circulation unless a drop in the efficiency of the combination of the spinning machine and the winding machine due to a lack of tubes, is to be tolerated. However, there is no indication regarding the quantity of the bobbin tubes in circulation, and blockages can occur if too many tubes are inserted into the circulation at once.

2. Description of the Related Art:

While it is possible to provide a certain buffer supply of bobbin tubes in the circulation from the start, in order to mitigate these shortcomings, a buffer supply requires additional costs because the space required is increased thereby, and also because facilities for accommodating the buffer supply must additionally be provided.

Furthermore, a buffer supply can only postpone the start of the difficulties since, as before, there is no indication regarding the bobbin tubes in circulation and their distribution over the spinning machine and the winding machine.

SUMMARY OF THE INVENTION

It is accordingly an object of the invention to provide a device for keeping a constant number of bobbin tubes in circulation between a spinning machine and a winding machine, which overcomes the hereinafore-mentioned disadvantages of the heretofore-known devices of this general type, and to keep a constant number of bobbin tubes in circulation between at least one spinning machine and at least one winding machine, within visible tolerance limits.

With the foregoing and other objects in view there is provided, in accordance with the invention, a device for keeping a constant number of bobbin tubes in circulation between at least one spinning machine and at least one winding machine, comprising means for circulating bobbin tubes between at least one spinning machine and at least one winding machine, a sorting device for sorting out partially wound bobbin tubes from the circulating means, and a tube input apparatus operatively connected to the sorting device including a tube magazine for introducing empty bobbin tubes into the circulating means in proportion to the number of partially wound bobbin tubes sorted out.

This can be done in different ways. For instance, an empty bobbin tube can be put in circulation immediately after a partially wound bobbin tube has been removed. However, it is possible to count the sorted-out, partially wound bobbin tubes and to subsequently introduce a quantity of empty bobbin tubes into circulation, corresponding to the result of the count. Furthermore, the number of bobbin tubes in circulation does not change within visible tolerance limits without counting, if a provision is made for the sorted-out, partially wound bobbin tubes to be freed of their partial windings right there and to be subsequently returned to the circulation.

In all of these cases it is advantageous if, according to a further embodiment of the invention, the tube input apparatus includes a tube magazine. As many bobbin sleeves can be dispensed in rapid sequence from a tube magazine as are needed at the moment. The tube magazine also serves as a tube buffer which is not included in the tube circulation.

In accordance with another feature of the invention, the tube input apparatus includes a tube cleaning device. In this way the bobbin tubes ultimately do not leave the combination of the spinning machine and the winding machine.

In accordance with an added feature of the invention, the tube cleaning device includes slip-on arbors for receiving partially wound bobbin tubes and a reel for unwinding threads from the partially wound bobbin tubes.

In accordance with an additional feature of the invention, the tube magazine includes means for receiving cleaned or unreeled bobbin tubes.

In accordance with a further feature of the invention there is provided a device for emptying a buffer quantity of bobbin tubes into the circulating means from the tube magazine. Then, the tube magazine cannot be over filled and on the other hand, it is possible to ensure that the tube magazine always contains a supply which is only used up if suddenly more bobbin tubes than usual are taken into the tube circulation in rapid sequence, for instance, upon request by the spinning machine.

In accordance with a concomitant feature of the invention, the sorting device includes means for controlling the tube input apparatus. It is thereby possible to accomplish the goal mentioned above, which is to insert an empty bobbin tube into the circulation for each sorted-out, partially wound bobbin tube. Furthermore, it is possible, for instance, to put five empty bobbin tubes in circulation following each other sequentially, to make up for five sorted-out, partially wound bobbin tubes, to point out only one variation in the operation of the device.

Other features which are considered as characteristic for the invention are set forth in the appended claims.

The construction and method of operation of the invention, however, together with additional objects and advantages thereof will be best understood from the following description of specific embodiments when read in connection with the accompanying drawings;

DESCRIPTION OF THE PREFERRED EMBODIMENT

Figure 1:
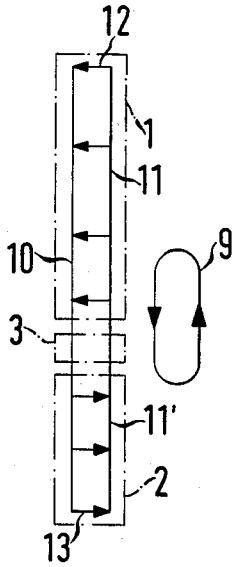
FIG. 1 is a diagram illustrating the tube circulation between a spinning machine and a winding machine.

Referring now to the figures of the drawings in detail and first, particularly, to FIG. 1 thereof, there is seen a spinning machine 1 and a winding machine 2 shown in phantom. A sorting device 3 for partially wound bobbin tubes 4 to 8 (shown in FIG. 2) is located therebetween. The tube circulation 9 is maintained by flat conveyors 10, 11, transverse conveyors 12 at the spinning machine and transverse conveyors 13 at the winding machine. In order to return bobbin tubes 14 to 17 (shown in FIG. 2) from the winding machine 2 to the spinning machine 1, the flat conveyor 11 is subdivided into sections 11′ and 11.

Figure 2:
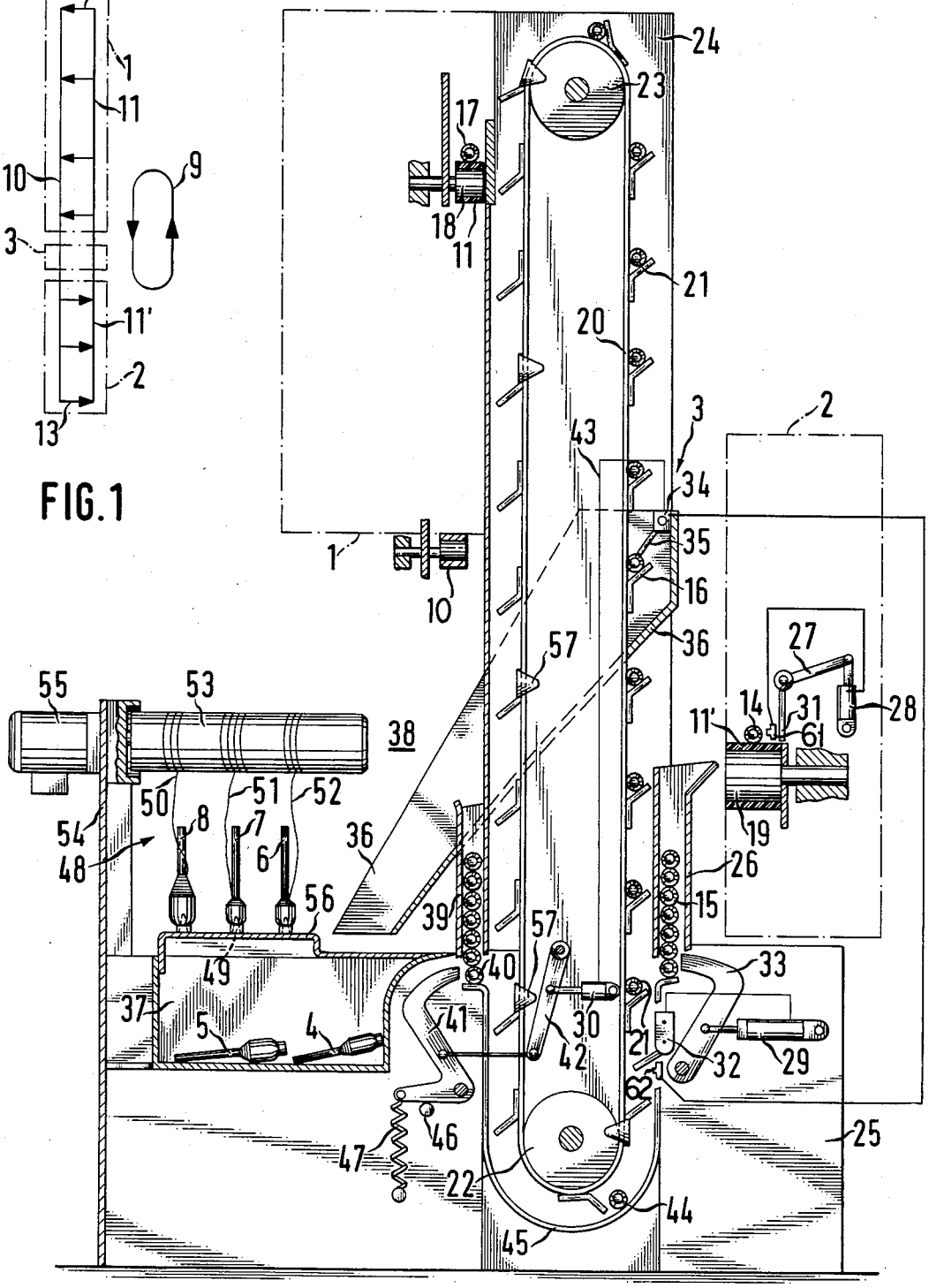
FIG. 2 is a diagrammatic, partially cross-sectional view of the device according to the invention.

According to FIG. 2, the flat conveyor section 11 is formed of a conveyor belt which runs over rollers 18. The flat conveyor section 11′ is also formed of a conveyor belt which runs over rollers 19.

According to FIG. 2, the sorting device 3 is formed of an elevator 20 which is formed of an endless belt that is equipped with attachments 21. A lower deflection roller 22 of the elevator 20 can be driven, but not an upper deflection roller 23. The upper deflection roller 23 is supported in a support 24 and the lower deflection roll 22 is supported in a machine frame 25.

On the ascending side of the elevator 20, there is a chute magazine 26 for bobbin tubes 15 which come from the flat conveyor section 11′. An ejector 31 operated by a pneumatic positioning motor 28 throws bobbin tubes 14 off the conveyor section 11′ into the chute magazine 26, in such a way that they arrive in sequence. An opto-electric sensor 61 connected to the motor 28, senses the presence of a bobbin tube 14 on the conveyor section 11′ and causes the ejector 31 to throw the tube 14 into the chute magazine 26. Another opto-electric sensor 62 senses the presence of an attachment 21 and triggers a feeler 31. The feeler 32 ascertains whether or not an arriving attachment 21 is empty, by passing slightly above the attachment 21, so as to determine whether or not a tube is present. The feeler 32 controls a pneumatic positioning motor 29 which in turn controls a tube dispenser 33. The tube dispenser 33 places a bobbin tube on an attachment 21, the receiving readiness of which has been ascertained by the feeler 32.

An ejector 34 is installed at half the height of the elevator 20, for actually sorting out partially wound bobbin tubes. Since the elevator 20 operates synchronously, the ejector 34 is also controlled by the sensor 62 and has time to run a feeler 35 horizontally along the bobbin tube 16 and to take the bobbin tube along in the process if it still has a residual winding. The feeler 35 passes slightly above the bobbin tube, so that if no residual winding is present on the tube, it will not eject it. Each bobbin tube which is taken along drops into a chute 36, beneath which a box 37 is disposed. Bobbin tubes which are not thrown off by the ejector 34 are transported to the flat conveyor 11 and from there to the spinning machine 1.

The sorting device 3 cooperates with a tube input apparatus 38. The tube input apparatus 38 includes a tube magazine 39, from which empty bobbin tubes 40 are put into circulation corresponding to the number of sorted-out, partially wound bobbin sleeves 4 to 8 from the chute 36. This is accomplished in the following manner:

A controllable tube input device 41 at the lower end of the tube magazine 39 is controlled by a lever 42 that is suspended in such a way that it can pivot. The lever 42 is flexibly connected to a pneumatic positioning motor 30. The pneumatic positioning motor 30 is connected to the ejector 34 of the sorting device 3 by an operational connection 43. Every time the ejector 34 ejects a partially wound bobbin tube, a positioning pulse is delivered to the pneumatic positioning motor 30 which thereupon actuates the lever 42 in order to make the tube input device 41 send an empty bobbin tube such as the bobbin tube 40, to the elevator 20. The empty bobbin tube 40 drops behind a lower enclosure 45 of the elevator 20 and thus arrives at the ascending side of the elevator 20, as did the empty bobbin tube 44 which was delivered previously, for instance. The tube input device 41 is reset against a stop 46 by a tension spring 47.

The tube input apparatus 38 is equipped with a tube cleaning device designated generally with reference numeral 48. The tube cleaning device 48 has slip-on arbors 49 for partially wound bobbin tubes 6, 7, 8 and a reel 53 which serves for unwinding threads 50, 51, 52. The reel 53 is supported on a support 54 connected to the machine frame and it is driven by a motor 55. The slip-on arbors 49 stand on a plate 56 which is fastened to the box 37.

From time to time and preferably during an annual review, the partially wound bobbin tubes accumulated in the box 37 are manually slipped on the slip-on arbors 49 and their threads are placed on the reel 53. The unwinding operation is then accomplished fully automatically and during the next manual review, the bobbin tubes which are then empty again, are manually filled into the tube magazine 39.

It goes without saying that from case to case, a substantially larger tube magazine and substantially more slip-on arbors are provided at the tube input apparatus 38.

It will be assumed that in practice the tube magazine 39 has a substantially large capacity. Since the tube magazine 39 is preferably filled up during a manual review, and since as a rule, the elevator 20 additionally transports the bobbin tubes in an irregular manner, these variations could cause fewer bobbin tubes to be in the circulation proper at certain times and at other times they could cause more bobbin tubes to be in circulation. It is even possible for the tube magazine 39 to be so full that it can no longer accept more tubes, although unwound bobbin tubes are waiting to be accepted.

In order to avoid such difficulties, the elevator 20 is provided with spaced apart cams or dogs 57 which actuate the lever 42 when passing and cause an empty bobbin tube to be delivered each time from the tube magazine 39 to the elevator 20. If only a few bobbin tubes arrive at the elevator from the winding machine 2 in time, the dog or cam control device provides a certain amount of equalization because it empties the tube magazine 39 steadily and independently of the demand by the sorting device 3, and allows the bobbin tubes to enter into circulation.

Although the invention is illustrated and described herein as embodied in a device for keeping a constant number of bobbin tubes in circulation between a spinning machine and a winding machine, it is nevertheless not intended to be limited to the details shown, since various modifications and structural changes may be made therein without departing from the spirit of the invention and within the scope and range of equivalents of the claims.

I claim:

1. Device for keeping a constant number of bobbin tubes in circulation between at least one spinning machine and at least one winding machine, comprising means for circulating bobbin tubes between at least one spinning machine and at least one winding machine, means for supplying said circulating means with bobbin tubes from the winding machine, means for conveying empty bobbin tubes from said circulating means to said at least one spinning machine, a sorting device for sorting out partially wound bobbin tubes from said circulating means, and a tube input apparatus operatively connected to said sorting device including a tube magazine and means for introducing empty bobbin tubes into said circulating means from said tube magazine in proportion to the number of partially wound bobbin tubes sorted out, said sorting device including means for controlling said tube input apparatus.

2. Device according to claim 1, wherein said tube input apparatus includes a tube cleaning device for tubes sorted out from said circulating means.

3. Device according to claim 2, wherein said tube cleaning device includes slip-on arbors for receiving partially wound bobbin tubes sorted out from said circulating means and a reel for unwinding threads from the partially wound bobbin tubes.

* * * * *